United States Patent [19]

Harley

[11] 3,954,295

[45] May 4, 1976

[54] FASTENERS

[75] Inventor: David N. Harley, North Harrow, England

[73] Assignee: ITW Limited, Slough, England

[22] Filed: Aug. 20, 1975

[21] Appl. No.: 606,154

[30] Foreign Application Priority Data

Aug. 21, 1974 United Kingdom ..... 36694/74

[52] U.S. Cl. ..... 292/319; 24/16 PB

[51] Int. Cl.[2] ..... B65D 27/30; B65D 33/34

[58] Field of Search ..... 292/317, 318, 319, 320, 292/322; 24/16 PB

[56] References Cited

UNITED STATES PATENTS

| | | | |
|---|---|---|---|
| 3,466,077 | 9/1969 | Moberg | 292/322 |
| 3,712,655 | 1/1973 | Fuehrer | 292/322 X |

*Primary Examiner*—Richard E. Moore

*Attorney, Agent, or Firm*—Jack R. Halvorsen; Robert W. Beart

[57] ABSTRACT

Tamperproof shackle seals formed as one-piece plastics mouldings and including, inter alia, the following features: a plug portion of non-circular outline for co-operation with a mating countersunk portion of the socket mouth to prevent effective insertion of a blade; a stop formed on the strap near the plug to limit the effective length of the strap when used with a padlock hasp; respective webs extending along the lengths of resilient fingers in the socket and connecting them either to the adjacent socket wall, or to those fingers disposed adjacently thereto on either side; to prevent free movement of the resilient fingers; and a filler for the plastics material which presents a barrier to heat re-sealing after tampering.

20 Claims, 10 Drawing Figures

FASTENERS

It is known to make tamperproof shackle seals in the form of one-piece plastics mouldings, each seal consisting principally of a strap carrying a plug at one end and a socket at the other. In use, the plug and strap of the shackle are passed through a fastening, such as loops on a bag or other container to be sealed, and the plug is then pushed and thereby secured in the socket.

One arrangement for securing the plug includes resilient fingers which extend back into the socket from the open end thereof. The plug has a rounded nose at its leading end followed axially by an undercut circumferential shoulder. The nose of the plug initially pushes the fingers outwards, but then they flex back to lie beneath the shoulder and thereby prevent withdrawal of the plug.

The purpose of these seals is not that they should lock the bag or other container by their strength, but that they should be unopenable except by causing visible damage.

A major weakness has been discovered in the use of these seals. Because of the slow recovery rate of the type of plastics material from which the seal has to be formed, it is possible to insert a thin blade between the plug and a finger and flex the finger from beneath the shoulder, a rapid circular scooping action with the blade then flexes back the other fingers. If this is done sufficiently quickly and with practice, the plug can be withdrawn before any of the fingers has recovered its moulded shape. After the container has been tampered with the seal can be remade and is in mint condition.

Secondary, but substantial disadvantages have been proved to be as follows:

The presence of the fingers within the socket requires the socket to be moulded initially having two open ends. It is therefore subsequently necessary to seal one end of the socket to prevent tampering with the fingers. The other end of the socket is closed by the plug.

One technique employed has been to heat-seal the one end, causing two disadvantages. Firstly, the end sealed by this technique is not neat, and it is feasible that an interloper can reheat the end and open it, or merely cut it open, release the plug from the fingers, then interfere with the container, resecure the shackle and repair the opened end of the socket by heating it, and the appearance would be indistinguishable from the manufactured shackle. Secondly, such a technique requires the plastics material of the shackle to be of a low temperature melting type. If has been found that immersion of the sealed shackle in hot water has made the material sufficiently flexible to permit the plug to be removed from the fingers with a narrow metal tool, without causing any evident damage.

The heat sealing technique also requires that the end to be sealed should be spaced from where the strap joins the socket. This has meant that the length of the socket could not form part of the periphery of the closed shackle, which is not the most economical use of the plastics material.

It has proved possible by cutting a number of axial notches in the plug, corresponding in number and disposition to the fingers, but being slightly out of axial alignment therewith, to make the shackle withstand the normal tug test, yet to be withdrawable after a small rotation of the plug relatively to the socket. Although this does involve damaging the plug in an evident manner, the plug has to be released from the socket in order to find the damage, and it is not easily seen anyway. Tampering with the shackles and interfering with the sealed contents of the containers could proceed for a substantial time before such tampering was detected. It is not inconceivable that the end of the plug could be reformed and the seal remade, rendering the interference completely undetectable.

It has also proved possible to cut the strap cleanly through at its junction with the plug, then weld the joints together neatly afterwards. This only involves loss of a very short length of the material of the strap.

Lastly, it has proved possible to introduce a tight sheath of SELLOTAPE (R.T.M.) or drinking straw, for example, over the end of the plug to wedge the plug between the fingers to resist the tug test, yet prevent the fingers engaging the shoulder of the plug, meaning that the plug could be subsequently withdrawn from the fingers by a pull harder than the tug test. The sheath is removed after tampering with the sealed contents, and then the plug pushed into the socket in the intended manner.

The present invention relates to improvements in a tamperproof shackle seal of the kind which will overcome all of the above disadvantages, and can be defined as a one-piece plastics moulding comprising a strap, a plug at one end of the strap and a socket at the other end of the strap; the plug having a leading end and a shoulder which faces away from said leading end; the socket having a sleeve-like wall which is closed at one end and has an open mouth at its other end; and a number of resilient fingers being fixed at first ends thereof to the wall and extending generally axially away from the mouth so that their remote ends are located in the socket; a first portion of the socket lying adjacent to the mouth, and a portion of the plug which in use cooperates with that first portion, having substantially similar non-circular internal and external outlines respectively, when viewed axially; and at least a part of said internal outline of the first portion lying radially outwards of an internal outline of an immediately adjacent second portion of the socket to define thereby a further shoulder which faces the mouth; whereby insertion of the plug into the socket causes the fingers to be flexed radially outwards until they can spring back for their remote ends to abut the shoulder and hold the plug captive in the socket, and insertion of a tool to occasion subsequent flexing of all the fingers is prevented by the further shoulder.

The main improvements concern either forming the strap with a stop which projects substantially perpendicularly therefrom and, in use, limits the effective length of the strap to that portion lying between the plug and the stop; or else connecting the resilient fingers along their lengths either to the adjacent socket wall, or to those fingers disposed adjacently thereto on either side, by respective webs.

The precise nature of the present improvements will be described below with reference to four seals shown in the accompanying drawings, in which.

Figure 1:
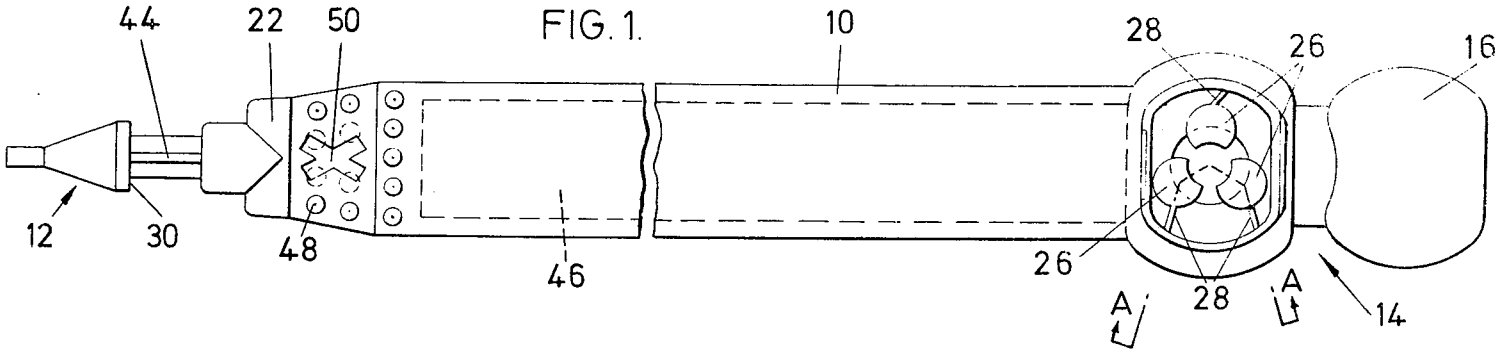
FIG. 1 is a fragmentary plan of an improved seal, the socket being seen in open form as initially moulded.

An improved seal, shown in FIGS. 1 to 4, in its as-moulded condition, consists of a strap 10 having a plug 12 at one end and a socket 14 at the other. To lock the shackle, the plug 12 is pushed into the socket 14 after loops to be secured, not shown, have been threaded onto the strap 10. The one-piece seal can advantageously be injection moulded in a high melt material such as nylon 66, or in a low melt material such as polypropylene which has been reinforced with glass fibres to increase its heat distortion temperature. It has been found that various fillers in the polymer present a barrier to heat re-sealing, and thereby resist re-welding after tampering. A currently preferred example of a filler which has been found to be suitable for this purpose is talcum powder. To make the seal operative for use a flap or rectangular lid 16, which is attached along one edge by a web 20 to a sleeve-like wall 18 of the socket, is hinged through 180° to overlie the upper end of the socket 14. The remaining three edges of the lid 16, which is a close neat fit over said upper end of the socket, are then securely sealed to the wall 18 by ultrasonic welding.

Figure 2:
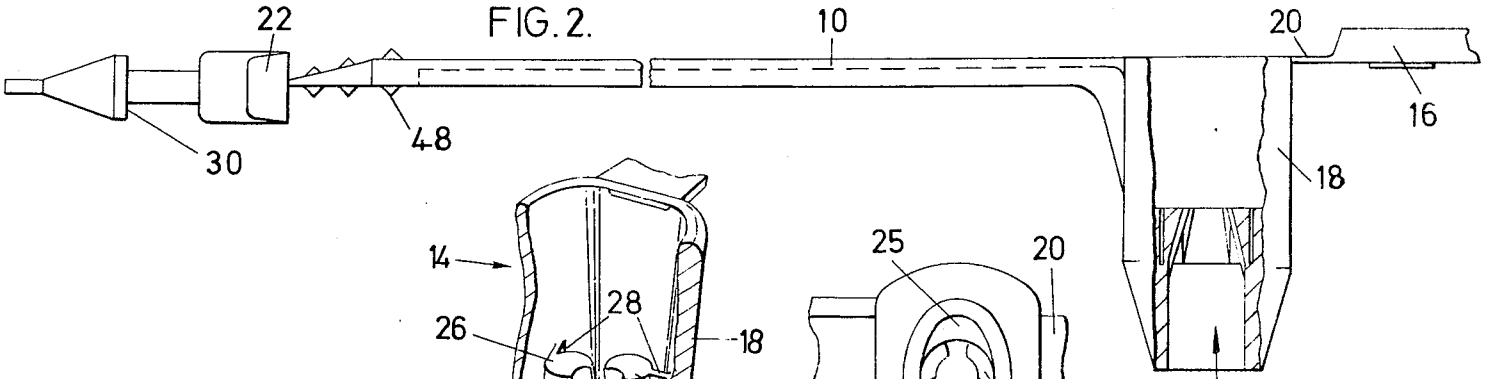
FIG. 2 is a fragmentary elevation, the right half including a section taken along the line A—A in FIG. 1.

When the shackle has been applied and the plug has been pushed home into the socket, the plug cannot be rotated relatively to the socket because a portion 22 at its base is oval shaped, as seen best by comparing FIGS. 1 and 2. Its length is substantially twice its width, and it fits in a tightly co-operating countersunk entrance portion formed adjacent to the mouth, or open end, 24 of the socket. Shoulders 25 (FIG. 4) facing the open end 24 are defined between the adjacent oval and circular outlined portions of the socket, and inter alia prevent the plug being pushed too far in.

The reader will appreciate that said oval outlined portion of the socket constitutes a first portion thereof according to the present invention, with said circular outlined portion constituting the second portion of the socket according to the present invention.

Figure 3:
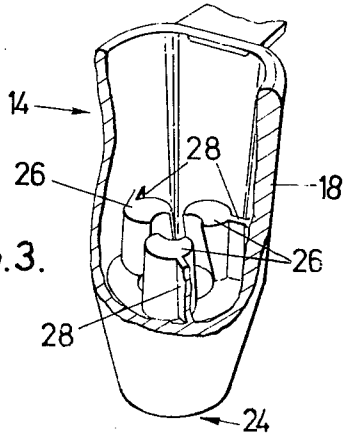
FIG. 3 is a fragmentary perspective view showing resilient webs extending between the wall of the socket and each of the three fingers.
Figure 4:
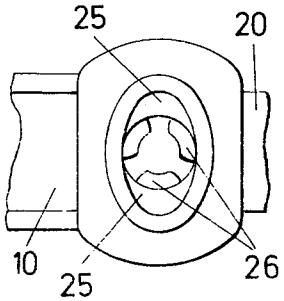
FIG. 4 is a fragmentary underneath view of merely the socket as shown in FIG. 2.

Three fingers 26, shown most clearly in FIG. 3, are fixed at first ends thereof to the wall 18, extend away from the open end 24 of the socket, and are circumferentially spaced at an angle of 120° to one another. The reader will note that the spring action of these fingers 26 is constrained by resilient webs 28 which connect each of the three fingers 26 respectively to the wall 18 of the socket 14. The presence of the resilient webs 28 significantly influences the yielding characteristics of the fingers 26, and after those fingers 26 have been snapped into a "locking" position in which their remote ends abut a shoulder 30 of the plug 12, the resilient webs act to resist any subsequent distortion thereof. In particular, the webs 28 would assist the fingers 26 to recover rapidly from any deflection. Although it might be possible to introduce a slim tool between the plug and the socket at the two points where the circle and the oval are tangential, or are nearest to tangential, it is not possible to perform a quick movement of the tool around the plug to flex all of the fingers away from engagement with the shoulder 30 because of the "further" shoulders 25 referred to above (see FIG. 4). Moreover, even if three grooves were cut in the plug 12, it would not be possible to rotate the plug to bring those grooves into alignment with the resilient fingers 26.

Figure 5:
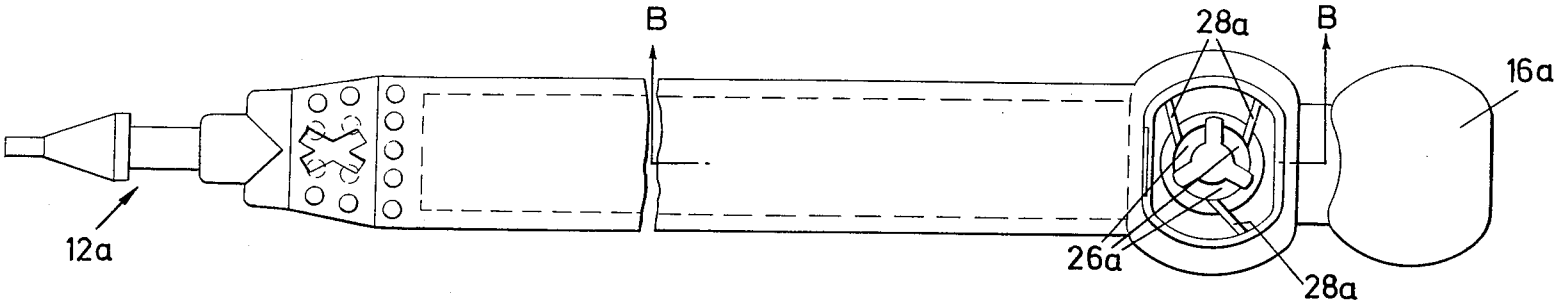
FIGS. 5 and 6 are similar to FIGS. 1 and 2, the right half of FIG. 6 including a section taken along the line B—B in FIG. 5, but show a second seal in which the thickness of each of the three fingers remains constant throughout its length.
Figure 6:
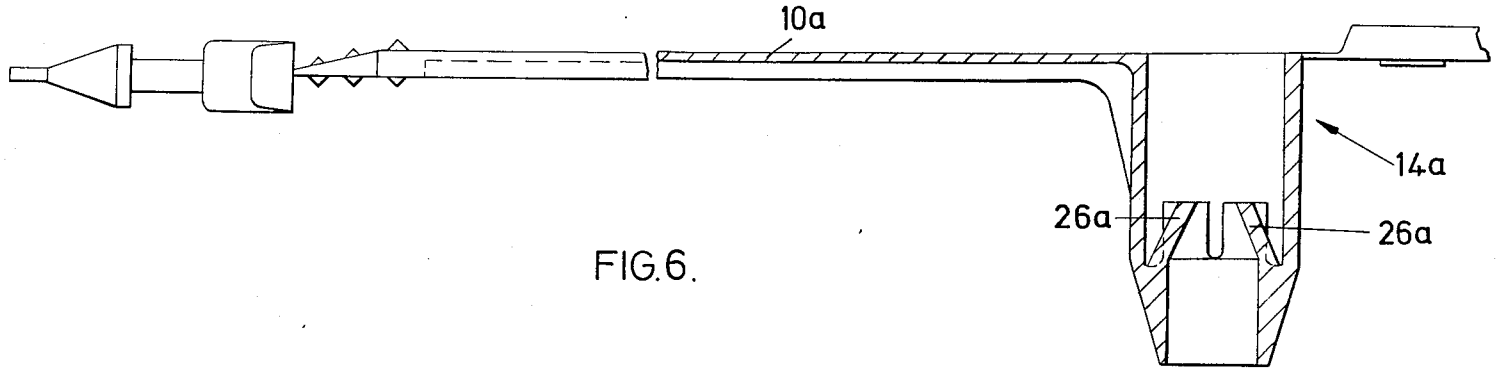

A second improved seal is shown in FIGS. 5 and 6, in which like numerals with the addition of the subscript *a* have been used to indicate parts corresponding to those described above with relation to FIGS. 1 to 4. The only difference between the second seal and that described above is that the fingers 26*a* are of uniform thickness throughout their length. That is to say, the roots, the central portions and the tips of the fingers 26*a* all have the same cross-section.

Figure 7:
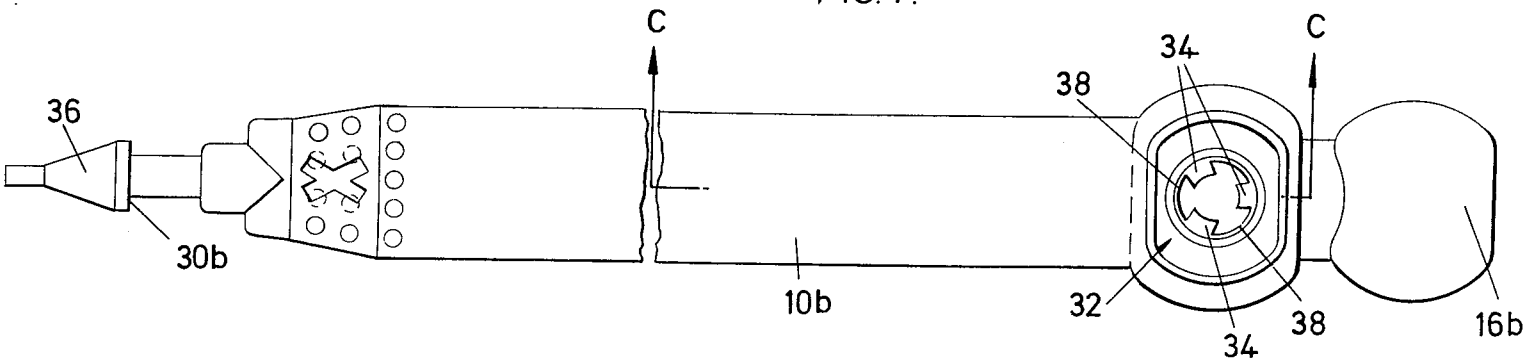
FIGS. 7 and 8 are also similar to FIGS. 1 and 2, the right half of FIG. 8 including a section taken along the line C—C in FIG. 7, but show a third seal in which the fingers and adjoining webs are replaced by a tube whose circumferential wall is relieved at spaced locations to enhance the inherent resiliency of the plastics material.
Figure 8:
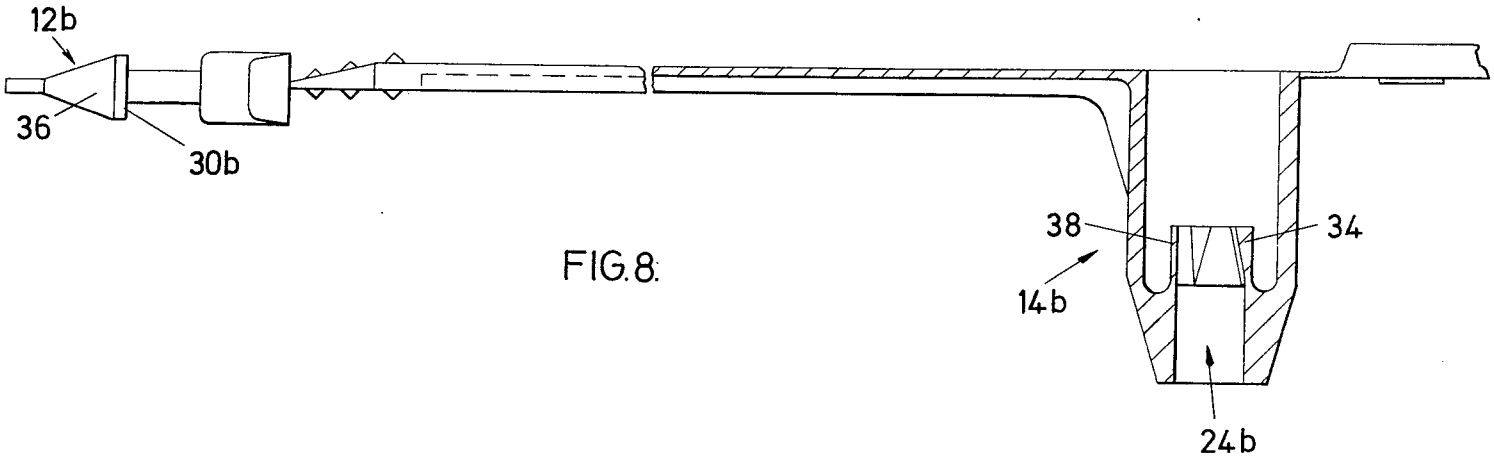

A third seal is shown in FIGS. 7 and 8, and parts similar to those described above are indicated by the same reference numerals with the addition of the subscript *b*. In this seal the three independent fingers 26 or 26*a* are replaced by a short tube 32 which extends in the axial direction of the socket away from the open end 24*b*. The tube 32 is relieved to form three "high" points 34, which are contacted by a leading end 36 of the "arrowhead" plug 12*b* during insertion. This causes the tube 32 to flex or bend to a roughly triangular shape (in plan) — that is to say, portions 38 of the tube 32 lying between the "high" points 34 are flattened — until the shoulder 30*b* of the plug 12*b* has completely passed through the tube 32. The inherent resiliency of the plastics material then causes the tube 32 to resume its as-moulded condition.

Figure 10:
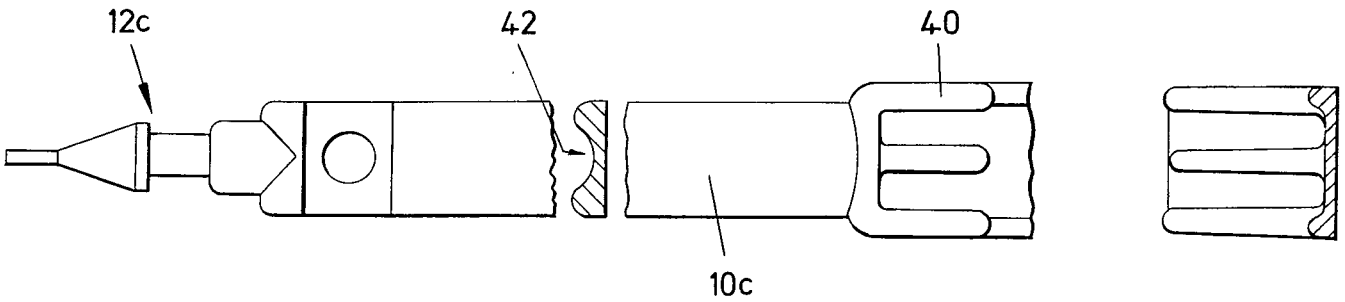
FIG. 10 is a fragmentary plan of merely the left-hand end of the seal shown in FIG. 9, two portions of the strap being seen in section.
Figure 9:
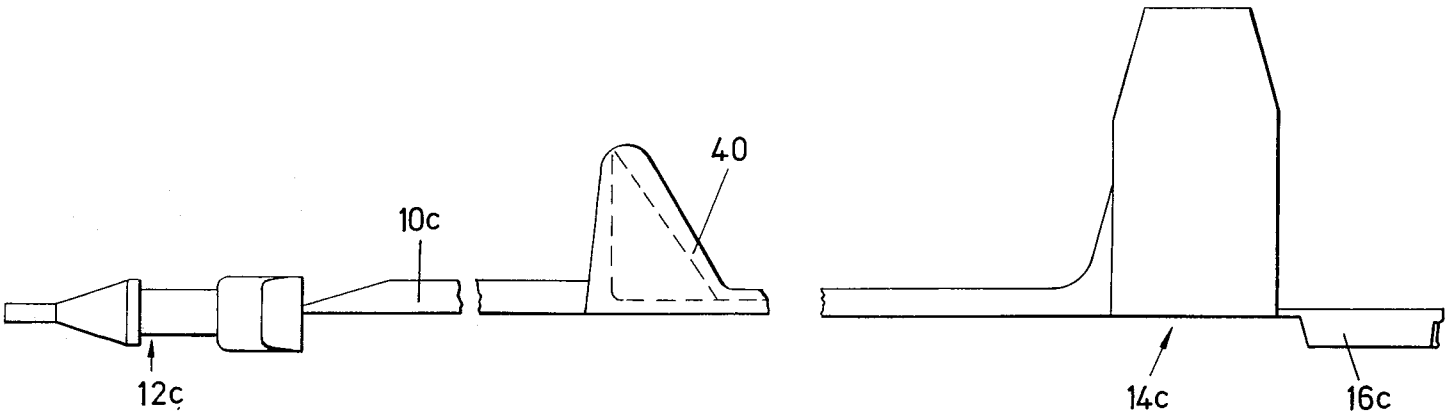
FIG. 9 is a fragmentary side elevation of a fourth seal showing a stop or collar formed on the strap near the plug.

In the fourth improved seal shown in FIGS. 9 and 10, like parts have been given the same reference numeral with the addition of the subscript *c*. The strap 10*c* is formed near the plug 12*c* with a stop or collar 40. The advantage of this is to limit the effective length without reducing the available printing area. If used in conjunction with a padlock for locking together a staple and a hasp carried by a container, undetected opening of the container is not possible even should the padlock be picked or otherwise undone. This of course naturally assumes that neither the socket 14*c* nor the stop 40 can pass through the areas defined by either the staple or the hasp carried by the container. Clearly, in use the hasp is located around that length of the strap 10*c* separating the plug 12*c* from the stop 40, one face of which length is formed as a hollow trough 42 into which a padlock hasp can nestle.

The oval form of the co-operating portions at the open end of any of the sockets described above is preferred because of the ease with which it can be moulded, but non-circular outlines such as rectangular or star are possible within this invention.

Many of the additional security features used in known tamperproof shackle seals can be included in the four seals described hereinbefore. For example, as a further aid to ensuring that the plug is held captive within the socket, at least one small rib 44 (shown in FIG. 1) should extend from the shoulder 30 towards the oval "co-operating" portion 22 of the plug. In use, each rib 44 should lie between a respective pair of adjacent fingers 26 in the socket 14.

A central length 46 of the strap 10 may carry markings for the purpose of providing an indication should the strap be broken and subsequently re-sealed. Preferably, for the same purpose, that end length of the strap closer to the plug 12 has a pattern of regularly spaced protuberances 48 over its surfaces. If an opening 50 of X-shape is formed through the strap at its junction with the plug, any breaking and subsequent re-sealing of the strap would also inevitably involve totally altering the shape of the opening 50. It is to be remembered that the primary purpose of the present tamperproof shackle seals is not that they should lock a container by their strength, but that they should be unopenable except by causing visible damage.

I claim:

1. A tamperproof shackle seal which is a one-piece plastics moulding, and comprises a strap, a plug at one end of the strap and a socket at the other end of the strap; the plug having a leading end and a shoulder which faces away from said leading end; the socket having a sleeve-like wall which is closed at one end and has an open mouth at its other end; a number of resilient fingers fixed at first ends thereof to the wall and extending generally axially away from the mouth so that their remote ends are located in the socket; a first portion of the socket lying adjacent to the mouth, and a portion of the plug which in use co-operates with that first portion, having substantially similar non-circular internal and external outlines respectively, when viewed axially; at least a part of said internal outline of the first portion lying radially outwards of an internal outline of an immediately adjacent second portion of the socket to define thereby a further shoulder which faces the mouth; and the strap being formed with a stop which projects substantially perpendicularly therefrom; whereby insertion of the plug into the socket causes the fingers to be flexed radially outwards until they can spring back for their remote ends to abut the shoulder and hold the plug captive in the socket, insertion of a tool to occasion subsequent flexing of all the fingers being prevented by the further shoulder, and the effective length of the strap being limited to that portion lying between the stop and the plug.

2. A seal according to claim 1, in which said effective length of the strap has one face formed as a hollow trough into which, in use, a padlock hasp can nestle.

3. A seal according to claim 1, in which each resilient finger is connected along its length to said sleeve-like wall by a respective web.

4. A seal according to claim 1, in which each resilient finger is connected along its length, to those fingers disposed adjacently thereto on either side, by a respective web.

5. A seal according to claim 4, in which each of the resilient fingers is constituted by a high unrelieved point formed on a socket which could be considered as being initially of substantially uniform annular cross-section, those portions of the socket located between said high points constituting the respective webs.

6. A seal according to claim 1, in which each of the resilient fingers is of uniform thickness throughout its length.

7. A seal according to claim 1, in which said first portion of the socket has an internal outline of oval shape.

8. A seal according to claim 7, in which said second portion of the socket has an internal outline of circular shape.

9. A seal according to claim 1, in which the closed end of the socket includes a rectangular lid connected by a web along one edge to said sleeve-like wall, the remaining three edges of the lid being sealed to the wall by ultrasonic welding.

10. A seal according to claim 1, in which at least one rib extends from the shoulder on the plug towards said co-operating portion of the plug, the arrangement being such that each rib lies, in use, between a respective pair of adjacent fingers in the socket to help ensure that the plug is held captive within the socket.

11. A seal according to claim 1, in which a central length of the strap carries markings for the purpose of providing an indication should the strap be broken and subsequently re-sealed.

12. A seal according to claim 11, in which at least one end length of the strap has a pattern of regularly spaced protuberances over its surface.

13. A seal according to claim 1, in which there is an opening of X-shape through the strap at its junction with the plug.

14. A seal according to claim 1, in which the strap joins the socket in the region of its closed end.

15. A seal according to claim 1, in which the plastics of the one-piece moulding is a high melt material.

16. A seal according to claim 1, in which the plastics of the one-piece moulding is polypropylene reinforced with glass fibres.

17. A seal according to claim 1, in which the plastics of the one-piece moulding has a filler to present a barrier to heat re-sealing.

18. A tamperproof shackle seal which is a one-piece plastics moulding, and comprises a strap, a plug at one end of the strap and a socket at the other end of the strap; the plug having a leading end and a shoulder which faces away from said leading end; the socket having a sleeve-like wall which is closed at one end and has an open mouth at its other end; a number of resilient fingers fixed at first ends thereof to the wall and extending generally axially away from the mouth so that their remote ends are located in the socket, with each resilient finger being connected along its length by a respective web to those fingers disposed adjacently thereto on either side; a first portion of the socket lying adjacent to the mouth, and a portion of the plug which in use co-operates with that first portion, having substantially similar non-circular internal and external outlines respectively, when viewed axially; and at least a part of said internal outline of the first portion lying radially outwards of an internal outline of an immediately adjacent second portion of the socket to define thereby a further shoulder which faces the mouth; whereby insertion of the plug into the socket causes the fingers to be flexed radially outwards, against the bias exerted by the webs, until they can spring back for their remote ends to abut the shoulder and hold the plug captive in the socket, insertion of a tool to occasion subsequent flexing of all the fingers being prevented by the further shoulder.

19. A seal according to claim 18, in which each of the resilient fingers is constituted by a high unrelieved point formed on a socket which could be considered as being initially of substantially uniform annular cross-section, those portions of the socket located between said high points constituting the respective webs.

20. A tamperproof shackle seal which is a one-piece plastics moulding, and comprises a strap, a plug at one end of the strap and a socket at the other end of the strap; the plug having a leading end and a shoulder which faces away from said leading end; the socket having a sleeve-like wall which is closed at one end and has an open mouth at its other end; a number of resilient fingers fixed at first ends thereof to the wall and extending generally axially away from the mouth so that their remote ends are located in the socket, with each resilient finger being connected along its length to the wall by a respective web; a first portion of the socket lying adjacent to the mouth, and a portion of the plug which in use co-operates with that first portion, having substantially similar non-circular internal and external outlines respectively, when viewed axially; and at least a part of said internal outline of the first portion lying radially outwards of an internal outline of an immediately adjacent second portion of the socket to define thereby a further shoulder which faces the mouth; whereby insertion of the plug into the socket causes the fingers to be flexed radially outwards, against the bias exerted by the webs, until they can spring back for their remote ends to abut the shoulder and hold the plug captive in the socket, insertion of a tool to occasion subsequent flexing of all the fingers being prevented by the further shoulder.

* * * * *